United States Patent [19]

Scoles

[11] Patent Number: 4,489,768

[45] Date of Patent: Dec. 25, 1984

[54] DISTRIBUTION DEVICE FOR BUTTER FILLING SYSTEM

[75] Inventor: John Scoles, Reedsburg, Wis.

[73] Assignee: Wisconsin Dairies Cooperative, Baraboo, Wis.

[21] Appl. No.: 414,855

[22] Filed: Sep. 3, 1982

[51] Int. Cl.[3] ..... B65B 3/04

[52] U.S. Cl. ..... 141/71; 141/258; 141/374; 53/122; 100/215; 100/295

[58] Field of Search ..... 53/527, 122; 100/295, 100/215; 141/12, 71–81, 250–284, 369–381

[56] References Cited

U.S. PATENT DOCUMENTS

| | | | |
|---|---|---|---|
| 473,494 | 4/1892 | Brine | 53/122 |
| 2,128,734 | 8/1938 | Schmidt | 226/93 |
| 2,360,756 | 10/1944 | Briggs | 226/129 |
| 2,657,649 | 11/1953 | Daanen et al. | 107/54 |
| 2,715,484 | 8/1955 | Alexander | 222/478 |
| 3,324,905 | 6/1967 | Paulo | 141/100 |
| 3,392,685 | 7/1968 | Briggs | 107/1 |
| 3,864,891 | 2/1975 | Piereder | 53/122 |
| 4,299,553 | 11/1981 | Swaroop | 425/572 |

FOREIGN PATENT DOCUMENTS

| | | | |
|---|---|---|---|
| 2280554 | 7/1975 | France | 53/122 |

*Primary Examiner*—Houston S. Bell, Jr.
*Attorney, Agent, or Firm*—Kenyon & Kenyon

[57] ABSTRACT

A distribution device for a butter filling system is disclosed. The distribution device receives fluent pressurized butter from a butter filling system, distributes the butter and discharges it from a plurality of outlets into a carton being filled. The distribution outlets are disposed about the periphery of the device to insure uniform filling of the carton.

13 Claims, 7 Drawing Figures

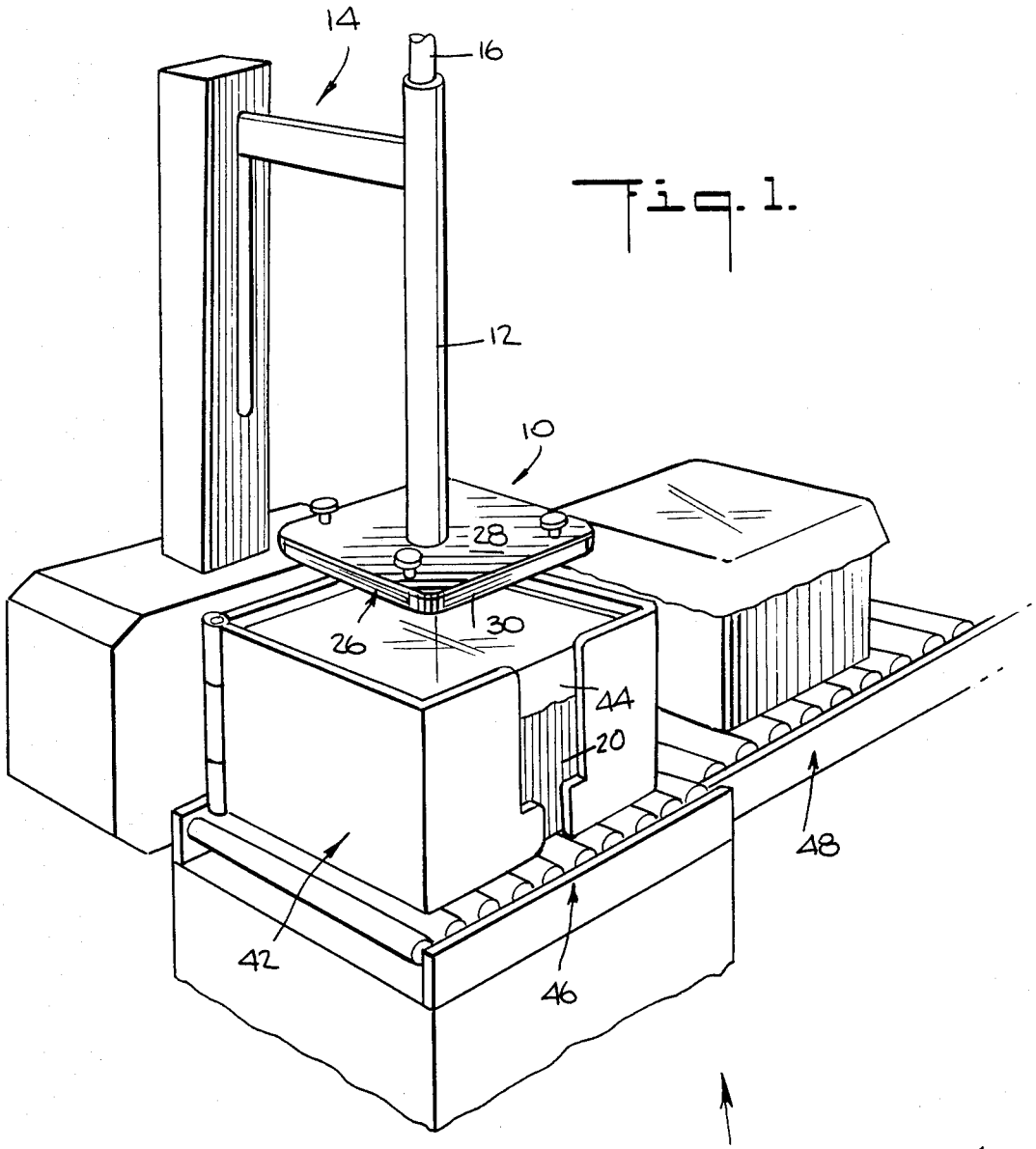
Fig. 1.
Fig. 3.
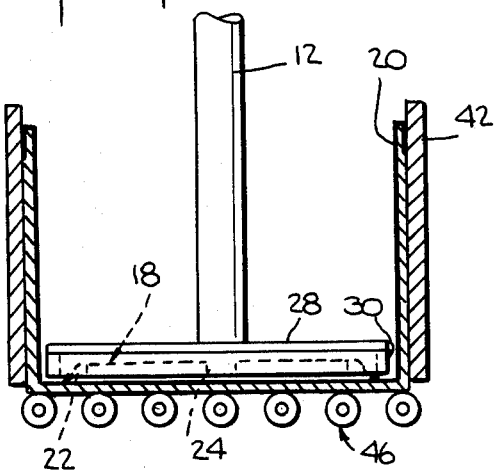
Fig. 4.
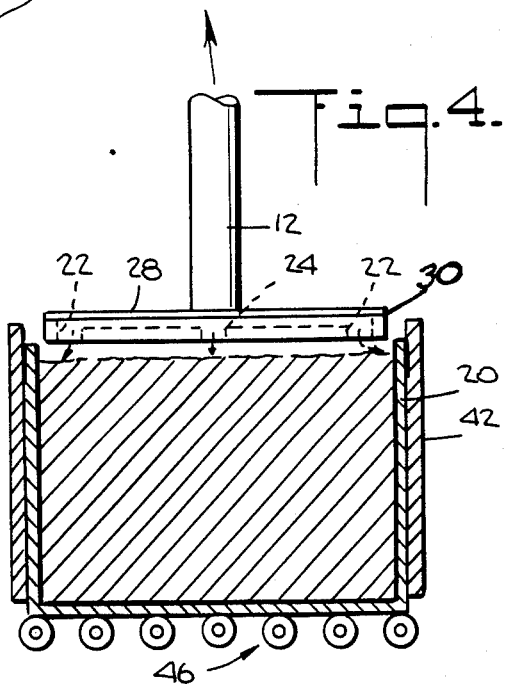

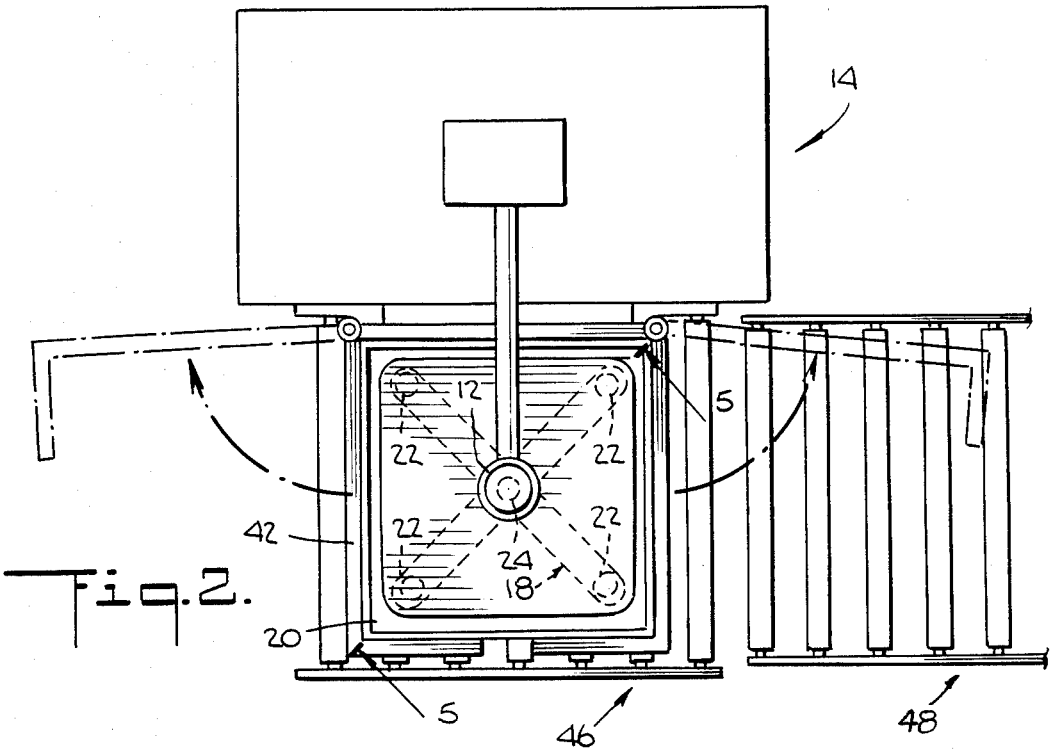
Fig. 2.
Fig. 6.
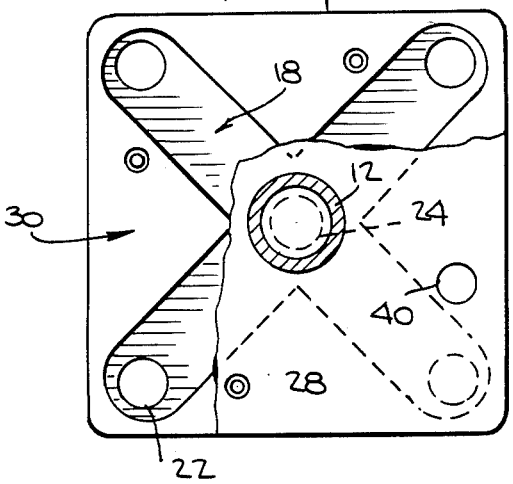
Fig. 7.
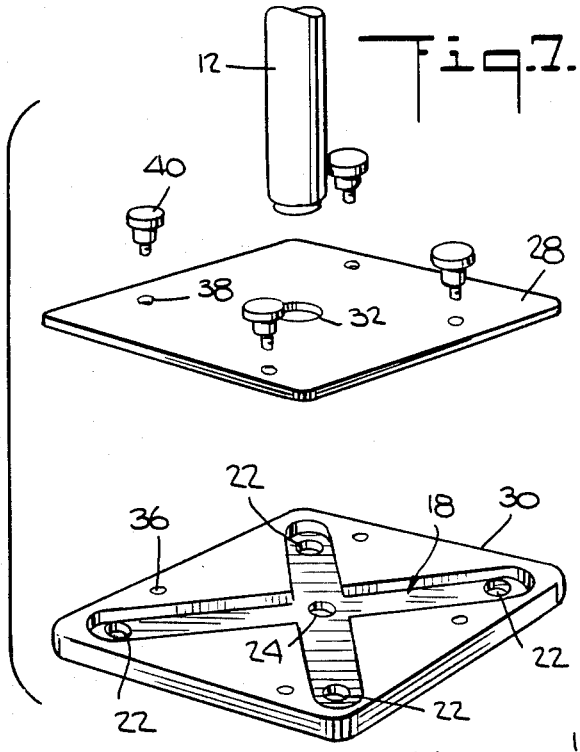
Fig. 5.
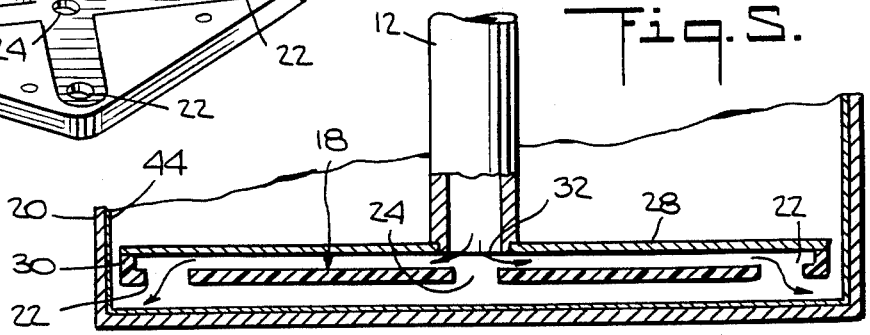

DISTRIBUTION DEVICE FOR BUTTER FILLING SYSTEM

BACKGROUND OF THE INVENTION

The present invention relates to a distribution device useful in a butter filling system to fill containers with butter.

A known butter filling system includes a cabinet having a conveyor top which can be raised and lowered pneumatically. A carton is positioned on the conveyor top below a tubular discharge conduit through which pressurized fluent butter is discharged into the carton. The tubular discharge conduit is removably connected to a rectangular pressure plate having a perimeter which substantially conforms to the interior cross-sectional configuration of the carton being filled. The plate has a single centrally located discharge outlet of circular cross section of about the same cross-sectional area of and in registration with the tubular discharge conduit. At the start of a filling cycle, the movable conveyor with a carton to be filled thereon is raised to an uppermost position in which the plate is positioned at the bottom of the carton. A pressure pump which pressurizes the butter and forces it through the discharge conduit is then automatically activated and pressurized fluent butter is discharged into the carton through the discharge outlet in the plate. The movable conveyor is progressively lowered under the weight of the butter being filled in the carton and the pressure of the butter against the plate. When the movable conveyor reaches a lowermost position, the pressure pump is automatically turned off to stop the discharge of butter. The filled carton is then rolled onto an adjacent conveyor which is level with the movable conveyor in its lowermost position.

In the known system, only the pressure and fluent condition of the butter act to distribute butter in the carton. Thus, in a rectangularly configured carton, it is possible that voids will remain at the corners of the carton. Additionally, since there is only a single discharge outlet, when the flow of butter is stopped, the filled height of the butter in the carton is uneven. Heretofore, the uneven height of the butter at the top of the carton was smoothed by hand to enhance the appearance of the butter in the carton and to satisfy government regulations.

The known system utilizes a pneumatically-operated valve in the butter discharge line to positively close the line after a carton has been filled and thereby prevent leakage of butter which otherwise can result from residual pressure in the line after the butter pressure pump is switched off. The pneumatic valve is switched on again only after the pump has fully pressurized the butter discharge line to commence filling the next carton. Each time the pneumatically-operated valve is cycled, a delay of about 5 to 7 seconds ensues. Since the valve must be turned on and off during the filling of each carton, approximately 10 to 14 seconds are lost for each carton filled.

The present invention provides a distribution device useful in a butter filling system which eliminates the aforementioned drawbacks.

OBJECTS AND SUMMARY OF THE INVENTION

It is an object of the present invention to provide apparatus for uniformly filling cartons with butter without voids in the carton.

It is another object of the present invention to provide apparatus for filling cartons with butter in which the butter is filled to an even height in the carton with a smooth, substantially planar top surface.

It is also an object of the present invention to provide an improved and faster operating butter filling apparatus.

The above and other objects are achieved in accordance with the invention by providing a distribution device useful in a butter filling system, having a plurality of spaced discharge outlets disposed in the device so as to be located spaced across the cross section of the carton being filled.

The distribution device is adapted to be coupled to a discharge outlet of a pressurized butter filling system having a support structure for a carton to be filled and means for moving either the discharge outlet or the support structure, or both, towards and away from each other. Thus, the distribution device can be positioned at the bottom of the carton when the discharge of butter into the carton is commenced and moved out of the carton as the carton is filled with butter.

The distribution device according to the invention comprises a body having an upstream surface, a generally smooth downstream surface and at least one cavity between the upstream and downstream surfaces. The exterior peripheral shape of the body generally conforms to the interior peripheral shape of the carton being filled. The device includes an inlet through the upstream surface into the cavity and is adapted to be coupled to the butter filling discharge outlet of the system so as to transfer pressurized fluent butter from the discharge outlet through the inlet into the cavity. The device further includes a plurality of spaced device outlets in the cavity through the downstream surface for discharging pressurized fluent butter from the cavity into the carton substantially across the cross section of the carton. Thus, the carton can be filled from a plurality of spaced locations. Preferably, the outlets are spaced about the outer periphery of the device to thereby discharge butter into the carton about the inner periphery of the carton. Each of the device outlets has a cross-sectional area which is less than the cross-sectional area of the cavity at the location in the cavity at which the respective outlet is disposed.

The downstream smooth surface is preferably planar in order that no surfaces can project into the butter in the carton during filling. This prevents butter from sticking to the distribution device and, in cooperation with the discharge outlets of the device and their location, enables the carton to be filled to a uniform height with butter which has a smooth and substantially planar top surface.

The cavity extends inwardly from a plurality of locations spaced about the periphery of the body at which the device outlets are disposed to a central location in the body below the inlet.

For a carton having an interior periphery of regular polygonal shape, the body is of a corresponding regular polygonal shape with an outlet adjacent each vertex of the body.

In the embodiment disclosed herein, the cavity can be described as star-shaped in which a device outlet is disposed at each point of the star with a further device outlet being disposed in the center of the star.

For a rectangularly configured carton, the body is of rectangular cross section and has a planar downstream surface, and the cavity is in the shape of a four-pointed star, or X-shaped. A device outlet is centrally disposed in the downstream surface and a device outlet is disposed at each of the four points of the star, i.e., at each corner of the body. The cavity for the rectangularly configured body is formed by channels extending diagonally through the body from opposed corners of the body.

The cross-sectional area of each device outlet is less than the cross-sectional area of the cavity in the location in the cavity (e.g. the end of a channel) at which the outlet is disposed. The applicant has discovered that the relationship of the outlet and the cavity cross sections are critical and that the cross section of the outlet must be less than the cross section of the cavity.

The applicant has further discovered that the need for a pneumatic valve in the butter line of the known butter filling system is due to the equal cross-sectional areas of the tubular discharge conduit and the circular discharge outlet in the plate which offers substantially no impedance to the flow of butter through the outlet. Thus, without the valve, butter leaks from the discharge outlet under the residual pressure in the pump, as discussed above. In accordance with this discovery, the applicant provides outlets in the device having smaller cross-sectional areas than those of the cavity and thereby eliminates the need for the pneumatic valve.

According to the disclosed embodiment, the body comprises a base in which the cavity is disposed and a cover in the form of a plate closing off the cavity. The base according to the disclosed embodiment forms the downstream portion of the device while the cover forms the upstream portion of the device.

Use of the device in a butter filling system provides cartons filled with butter which satisfy the requirements of the United States Department of Agriculture that all bulk butter cartons be uniformly filled to all corners and smooth on the top.

The above and other objects, features, aspects and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which:

FIG. 1 is a perspective view of the discharge portion of a butter filling system and of a distribution device according to the invention positioned at the start of a filling cycle;

FIG. 2 is a top view of the portion of the filling system and the distribution device depicted in FIG. 1 with the distribution device inserted into a carton during filling of the carton;

FIG. 3 is a side view in section of the distribution device inserted into the carton during filling;

FIG. 4 is a side view in section of the distribution device being removed from the carton after the carton has been filled;

FIG. 5 is a section view taken through line 5-5 of FIG. 2;

FIG. 6 is a top view partly broken away of the distribution device according to the invention; and FIG. 7 is an exploded perspective view of the distribution device according to the invention.

DESCRIPTION OF THE PREFERRED EMBODIMENTS

Referring more particularly now to the drawings, an embodiment of a distribution device according to the invention for a butter filling system is illustrated. As depicted in FIGS. 1 and 2, the distribution device 10 is coupled to a discharge tube 12 of a butter filling system referenced generally by 14, only the discharge portion of which is shown. Butter, fluidized and under pressure, is supplied from the butter filling system 14 through a flexible tube 16 to the discharge tube 12. The discharge tube 12 supplies the pressurized fluent butter to a cavity 18 (FIG. 2) in the distribution device 10 from which the butter is discharged into a carton 20 through a plurality of outlets 22, 24 in the distribution device 10.

The distribution device 10 comprises a body 26 shown in the drawings to be of rectangular cross section, thereby conforming to the interior cross section of the carton. Referring to FIGS. 5–7, the body 26 is comprised of an upstream plate 28 and a downstream base 30. The plate includes an inlet 32 through which pressurized fluent butter is passed from the tube 12 into the cavity 18. The cavity 18 is formed in the base open at the upstream side thereof and is closed by the plate 28. The cavity extends from a central location in the body below the inlet 32 in channel fashion to the four corners of the body. The cavity can thus be described as star-shaped and for a base of rectangular configuration the star has four points. For a rectangularly-configured body, the cavity may also be described as X-shaped. The cavity is defined by elongated channels of generally rectangular cross section extending diagonally across the body and intersecting generally in the center of the base. An outlet 22 is provided at each point of the star (each tip of the X) in the corners of the body and a central outlet 24 is provided at the intersection of the longitudinal channels, i.e. at the center of the star or X.

The cross-sectional areas of the outlets 22 and 24 are less than the cross-sectional area of the cavity at the locations in the cavity at which the outlets are disposed. Thus, the diameter(s) of the circular outlets 22 and 24 is less than the width of the longitudinal channels. The relative dimensions of the outlets and the channels are critical in that the flow of butter through the cavity and the outlets can be seriously impeded when the cross-sectional area of the outlets approaches or exceeds the respective cross-sectional area of the cavity.

Since the base projects into a carton being filled and contacts butter in the carton, the base 30 has a smooth exterior downstream surface which is preferably planar thereby preventing butter from sticking to that surface.

The discharge tube 12 is secured to the plate 28 in the central inlet 32 to thereby communicate the interior of the conduit with the interior of the cavity. Preferably, the cross-sectional areas of the tube 12 and the inlet 32 are approximately equal. The tube 12 can be secured to the plate 28 in any suitable manner, as for example by threads.

The base includes a plurality of threaded holes 36 and the plate includes a plurality of through holes 38 which register with the threaded holes when the plate is disposed on the base. Threaded bolts 40 extending through the holes 38 into the threaded holes 36 secure the plate to the base.

The base is preferably made of Nylon but could also be made of sand blasted stainless steel or other materials which meet government regulations.

A filling cycle which illustrates operation of the distribution device will be described with reference to FIGS. 1–4. At the start of a filling cycle (FIG. 1), a carton 20 is enclosed by a hinged retaining device 42 which supports the carton during pressurized filling. A liner 44 made of plastic material satisfying government regulations is disposed in the carton. The distribution device is mounted to a lowermost position at which the device is disposed in the carton 20 at the bottom thereof (FIGS. 2 and 3), and the flow of butter is commenced from the discharge tube 12 through the distribution device and into the carton. As the butter is discharged under pressure into the carton, the butter bears against the downstream surface of the distribution device and forces it upwardly as the carton is filled until the distribution device reaches the top of the carton as shown in FIG. 4. The flow of butter is then stopped and the distribution device is raised above the carton to the position shown in FIG. 1. The retainer device is opened to the broken line position shown in FIG. 2 so that the filled carton can be rolled from the conveyor portion 46 below the distribution device to the conveyor portion 48 for transporting to other stations. The next carton to be filled is then delivered to the conveyor portion 46 and the hinged retainer device 42 closed.

The distribution device of the invention enables a carton to be uniformly filled with substantially no voids at the corners of a carton of rectangular cross section. Additionally, the distribution device provides a smooth finish of the butter at the top of the carton without requiring any finishing operations.

Utilization of the distribution device of the invention in an otherwise conventional butter filling system eliminates the need for the pneumatic valve described above in the butter discharge line. The distribution device provides sufficient residual restriction to stop the flow of butter through the device without the need for a positive shut-off valve in the butter discharge line. Since such a valve is not needed, the pump can be turned on and off immediately thereby saving the cycling time associated with the valve.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention heren chosen for the purpose of disclosure without departing from the spirit and scope of the invention.

What is claimed is:

1. A distribution device for a butter filling system which includes a discharge outlet through which pressurized fluent butter is supplied, a support structure for a carton to be filled with butter supplied from the discharge outlet and means for relatively moving at least one of the discharge outlet and the support structure towards and away from each other, the device comprising a body having an upstream surface, a generally smooth downstream surface and at least one cavity disposed between the upstream and downstream surfaces, the exterior peripheral shape of the body generally conforming to the interior peripheral shape of the carton to be filled, an inlet through the upstream surface into the cavity adapted to be coupled to the butter filling system discharge outlet to convey pressurized fluent butter from the butter filling system discharge outlet into the cavity, a plurality of spaced device discharge outlets in the cavity and through the downstream surface for discharging pressurized fluent butter from the cavity into a carton to be filled at a plurality of spaced locations therein, each of the device discharge outlets having a cross-sectional area which is less than the cross-sectional area of the cavity at the location in the cavity at which the respective device discharge outlet is disposed.

2. The device according to claim 1 wherein the downstream surface of the body is planar.

3. The device according to claim 1 wherein at least one of the device discharge outlets is centrally disposed in the cavity and a plurality of the device discharge outlets are disposed in the cavity about the periphery of the body.

4. The device according to claim 1 wherein the cavity extends from a plurality of locations spaced about the periphery of the body to a central location in the body.

5. The device according to claim 1 wherein the cavity is formed by a plurality of channels extending from the periphery of the body and intersecting generally in the center of the body.

6. The device according to claim 1 wherein the body is of regular polygonal exterior configuration and a device discharge outlet is disposed in the cavity of the body adjacent to each vertex of the body.

7. The device according to claim 1 wherein the cavity is star-shaped, the star having at least three points adjacent to each of which a device discharge outlet is disposed, another device discharge outlet being disposed in the center of the star.

8. The device according to claim 1 wherein the body is of rectangular cross section having a planar downstream surface.

9. The device according to claim 8 wherein the cavity is star-shaped having channels extending diagonally through the body from opposed corners of the body.

10. The device according to claim 9 wherein a device discharge outlet is centrally disposed in the downstream surface and a device discharge outlet is disposed adjacent to each corner of the body.

11. The device according to claim 1, wherein the body comprises a base in which said cavity is disposed and a cover closing off said cavity.

12. The device according to claim 11 wherein the cavity in the base faces upstream and is closed on the upstream side of the base by the cover.

13. A distribution device for a butter filling system which includes a discharge outlet through which pressurized fluent butter is supplied, a support structure for a carton to be filled with butter supplied from the discharge outlet and means for relatively moving at least one of the discharge outlet and the support structure towards and away from each other, the device comprising a body of polygonal exterior peripheral shape having an upstream surface, a generally smooth downstream surface and at least one cavity disposed between the upstream and downstream surfaces formed by a plurality of channels extending from corners of the body and intersecting generally in the center of the body, the exterior peripheral shape of the body generally conforming to the interior peripheral shape of the carton to be filled, an inlet through the upstream surface into the cavity adapted to be coupled to the butter filling system discharge outlet to convey pressurized fluent butter from the butter filling system discharge outlet into the cavity, a plurality of spaced device discharge outlets in the cavity and through the downstream surface for discharging pressurized fluent butter from the cavity into a carton to be filled at a plurality of spaced locations therein, at least one of the device discharge outlets being centrally disposed in the cavity and a plurality of the device discharge outlets being disposed in the cavity adjacent each corner of the body, each of the device discharge outlets having a cross-sectional area which is less than the cross-sectional area of the cavity at the location in the cavity at which the respective device discharge outlet is disposed.

* * * * *